United States Patent [19]

Heijnen et al.

[11] Patent Number: 4,621,734

[45] Date of Patent: Nov. 11, 1986

[54] TOP-GRIPPING CARRIER WITH INTERLOCKED PANELS

[75] Inventors: Johan Heijnen, Bergen Op Zoom; Martinus Bakx, Roosendaal, both of Netherlands

[73] Assignee: The Mead Corporation, Dayton, Ohio

[21] Appl. No.: 822,708

[22] Filed: Jan. 27, 1986

[30] Foreign Application Priority Data

Jan. 25, 1985 [GB] United Kingdom ..... 8502015
Jul. 24, 1985 [GB] United Kingdom ..... 8518725

[51] Int. Cl.[4] ..... B65D 75/00; B65D 85/62; B65D 71/00

[52] U.S. Cl. ..... 206/427; 206/151; 206/153; 206/157; 206/158

[58] Field of Search ..... 206/143, 148, 151, 157, 206/158, 160, 427, 153, 156, 434, 429, 435, 150, 149; 229/40

[56] References Cited

U.S. PATENT DOCUMENTS

| | | | |
|---|---|---|---|
| 3,016,259 | 1/1962 | Lawrence | 206/153 |
| 3,123,213 | 3/1964 | Kulig | 206/158 |
| 3,139,981 | 7/1964 | Akeireb | 206/153 |
| 3,387,879 | 6/1968 | Wood | 206/158 |
| 3,876,006 | 4/1975 | Klygis | 206/158 |
| 4,218,086 | 8/1980 | Klygis | 206/153 |
| 4,326,628 | 4/1982 | Wood | 206/427 |
| 4,421,232 | 12/1982 | Konaka | 206/157 |

*Primary Examiner*—William Price
*Assistant Examiner*—Brenda J. Ehrhardt
*Attorney, Agent, or Firm*—Erwin Doerr

[57] ABSTRACT

An article carrier of the top-gripping type which connects together and supports a plurality of bottles by their flanged neck portions is formed from a single elongate blank (10) of foldable sheet material having a series of panels (12, 14, 16, 18, 20) joined together and the blank including terminal panels (12, 20) at opposing ends thereof and which, when assembled provides a top (16) and a base (12, 20) interconnected by spaced side wall panels (14, 18) and together form a tubular structure. The top and base each have a plurality of article receiving apertures (A1–A4:N1–N4) with the apertures in the top disposed in registry with the apertures in the base. At least one retention tab (T1, T2) is provided on at least one (20) of the terminal panels, the retention tab being positioned adjacent one of the apertures (N3, N4) in the base and being engaged therein to extend within the tubular structure so as to maintain the carrier in erected condition when a bottle has been inserted in the base and the flange or cap thereof positioned in the aperture in the top whereby the retention tab is maintained in folded condition by the bottle.

8 Claims, 4 Drawing Figures

TOP-GRIPPING CARRIER WITH INTERLOCKED PANELS

This invention relates to an article carrier of the top-gripping type which is particularly suitable for use with bottles.

Top-gripping carriers which support a number of bottles by their necks in a group are well known. Usually, such carriers are pre-formed and supplied in completed flat-folded condition ready to be erected and applied to a group of bottles. In order to pre-form the carrier it is customary to form the carrier from a wrapper blank in which the base panels are secured by gluing.

The present invention offers a top-gripping carrier, which does not require to be glued and may or may not be pre-formed.

One aspect of the invention provides an article carrier of the top-gripping type which connects together and supports a plurality of bottles by their flanged neck portions, the carrier being formed from a single elongated blank of foldable sheet material having a series of panels joined along transverse fold lines, said blank including terminal panels at opposing ends thereof and which, when assembled, provides a top and a base interconnected by spaced side wall panels and together form a tubular structure, said top and base each having a plurality of article receiving apertures with the apertures in the top disposed in registry with the apertures in the base, at least one retention tab being provided on at least one of said terminal panels, said retention tab being positioned adjacent one of said apertures in the base and being engaged therein, characterized in that said retention tab is folded inwardly through said one aperture to extend within said tubular structure so as to maintain said carrier in erected condition when a bottle has been inserted through the aperture in the base and the flange or cap thereof positioned in said aperture in the top whereby said retention tab is maintained in folded condition by said bottle.

Yet another aspect of the invention provides a method of assembling a carrier of the top-gripping type which connects together and supports a plurality of bottles by their flanged neck portions or caps, said carrier being formed from a single elongated blank of sheet material having a series of panels joined along transverse fold lines, said blank including terminal panels at opposing ends thereof and when assembled into a tubular structure, provide a top and a base interconnected by spaced side wall panels, said top and base having a plurality of article receiving apertures and at least one retention tab being provided on at least one of said termial panels in general alignment with a respective one of said apertures in the base, the method being characterized by the steps of folding said blank about said fold ines so that the apertures in the top are disposed in registry with the apertures in the base and said retention tab is disposed adjacent said respective aperture in the base, folding said retention tab relative to its associated terminal panel inwardly through said respective aperture in the base to extend within the tubular structure, and inserting a bottle with its neck portion through said respective aperture in the base so that the flange or cap thereof is positioned in the aperture in the top whereby said retention tab is maintained in folded condition by said bottle.

Two embodiments of the invention will now be described, by way of example, with reference to the accompanying drawings, in which.

Figure 1:
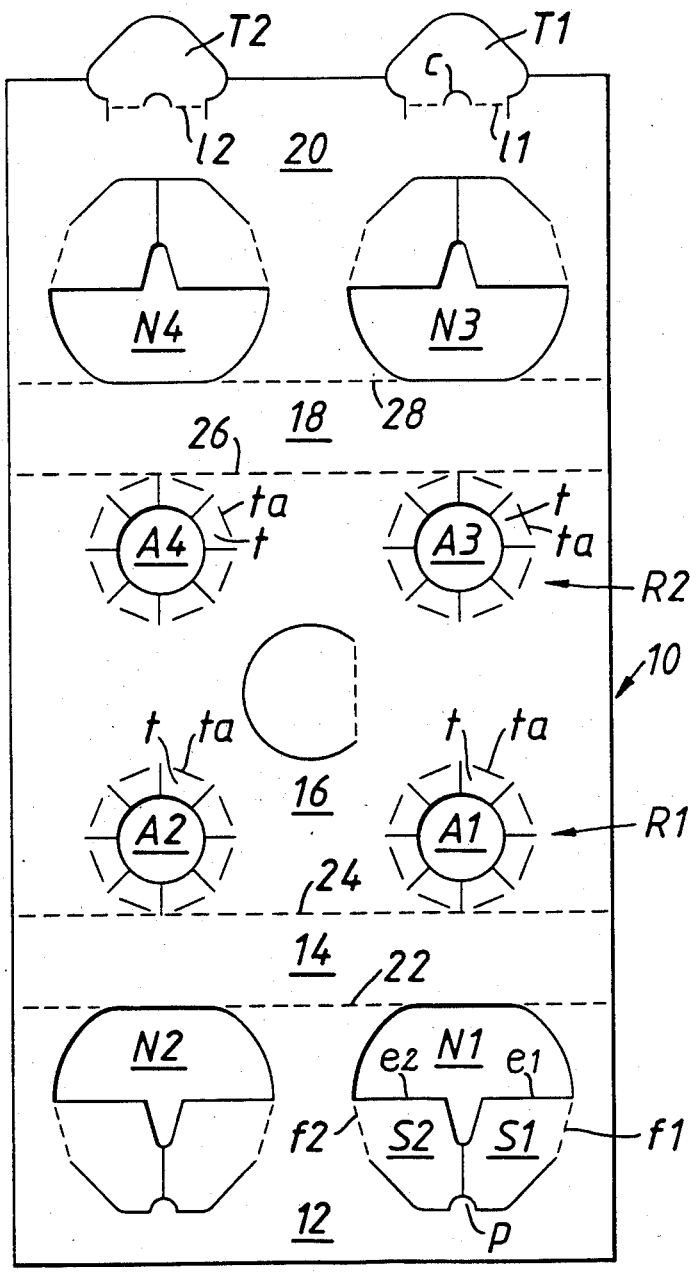
FIG. 1 is a plan view of one wrapper blank for forming a double-row top-gripping according to the invention.
Figure 3:
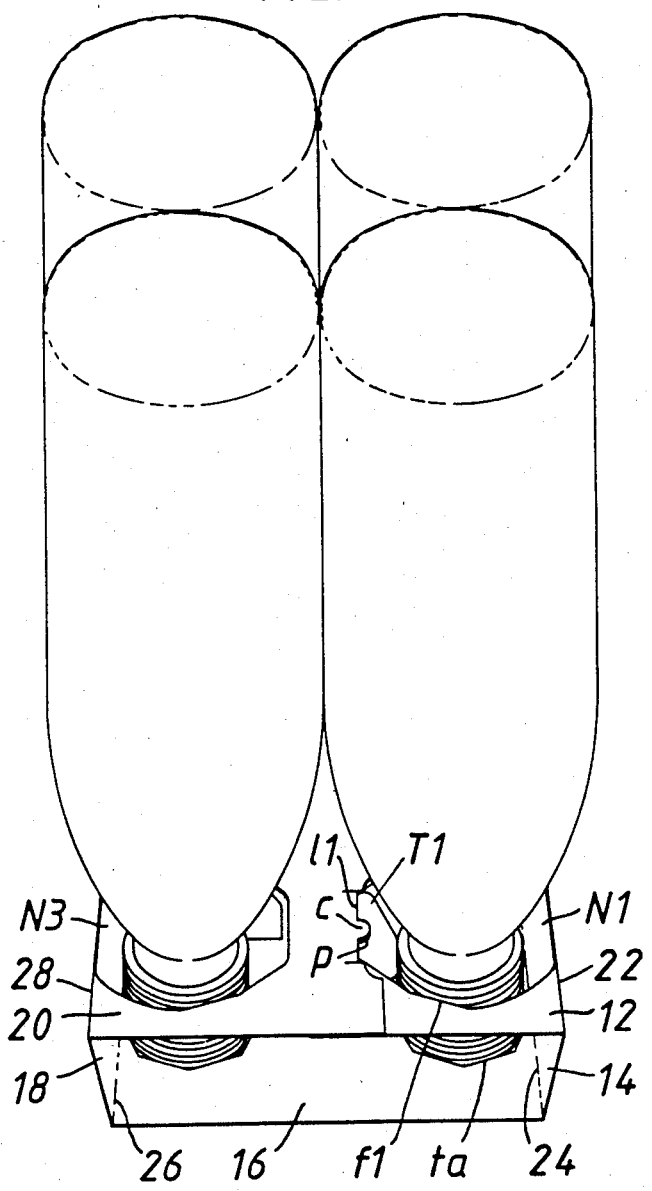
FIG. 3 is a perspective view of a carrier formed from the blank of FIG. 1, being shown in an inverted attitude and loaded with four bottles.

Referring to FIGS. 1 and 3, FIG. 1 shown an elongate blank 10 formed from paperboard or similar foldable sheet material which comprises, in series, a first (female) base panel 12, a first side wall panel 14, a top panel 16, a second side wall panel 18 and a second (male) base panel 20 hinged one to the next along transverse fold lines 22, 24, 26 and 28 respectively.

The top panel 16 is formed with a first row R1 of spaced apertures A1 and A2 disposed adjacent the first side wall panel 14 and a second row R2 of spaced apertures A3 and A4 disposed adjacent the second side wall panel 18. Each of the apertures is adapted to receive the top of a bottle and includes an annular series of tabs 't' hinged to the top panel about short fold lines ta. As is well known when the completed carrier is applied to a group of bottles, a bottle top is inserted through each aperture A whose hinged tabs are upwardly displaced and locate beneath the bottle top to assist in the stabilisation and/or retention of the bottle in the carrier.

The first female base panel 12 is formed with a pair of spaced bottle neck receiving apertures N1 and N2 which are disposed so as to be in register beneath apertures A1 and A2 respectively when the blank is formed into a tubular structure in which the base panels are secured together in overlapping relationship as described below. A pair of similar bottle neck stabilising flaps S1 and S2 are hinged to oppose peripheral edges of the aperture N1 along fold lines f1 and f2 respectively, and interfere with the space defined by aperture N1. A locking projection 'P' is formed at the peripheral edge of aperture N1 remote from the free edges e1 and e2 of the stabilising flaps S1 and S2 respectively. Aperture N2 has stabilising flaps and a locking projection of like arrangement and is not therefore described in further detail.

Similarly the second base panel 20 is formed with a pair of spaced bottle neck receiving apertures N3 and N4 which are disposed so as to be in register beneath apertures A3 and A4 respectively when the blank is formed into a tubular structure. Both apetures N3 and N4 include stabilising flaps of similar arrangement to aperture N1 but neither aperture includes a locking projection.

Base panel 20 includes a pair of locking tabs T1 and T2 each of which is hinged adjacent the free marginal edge of panel 20 along interrupted fold lines e1 and e2 respectively. Fold line e1 is interrupted by a central cut line 'c' which forms an arcuate aperture adjacent the hinged base of the locking tab T1. Locking tab T2 is of like construction.

In use, the blank 10 is formed into a tubular structure (by a suitable folding device) which folds the blank panels about the transverse fold lines thereof so that the top panel 16 is brought into superposed relationship with respect to the base panels which are themselves brought into partial overlapping relationship so that locking tabs T1 and T2 overlie the stabilising flaps of apertures N1 and N2 respectively. The top panel and base panels are spaced apart by the side wall panels 14 and 18 thereby forming a tubular structure.

The tubular structure is then applied to a group of bottles so that a neck portion is introduced through each of the bottom panel apertures N1-N4 and through the registering top panel apertures A1-A4. Referring specifically to locking tab T1 and base panel aperture N1, as a bottle neck is inserted through aperture N1 it strikes against the locking tab T1 overlying stabilising flaps S1 and S and displaces the locking tab T1 about its interrupted fold line e1 and simultaneously displaces the stabilising flaps S1 and S2 about fold lines f1 and f2 in a direction towards the superposed to panel 16 and into the spaces between the top and base panels. In so doing, the locking projection 'p' engages into the arcuate recess defined by cut line 'c' of locking tab T1 and thereby locks the locking tab T1 in the aperture N1. Locking tab T1 is similarly engaged in aperture N2 by a bottle introduced into aperture N2 thereby securing together the base panels of the carrier.

When the neck portion of the bottle is fully inserted through aperture N1 and A1 the displaced stabilising flaps S1, S2 and the displaced locking tab engage against the neck portion of the bottle and stabilise the bottle against undue sideways movement in the carrier. The stabilising and locking tabs associated with the other apertures N2, N3 and N4 are similarly displaced and also serve to stabilise bottles present in those apertures.

A modified carrier of similar construction but which includes a lesser or greater number of bottles receiving apertures in each row is envisaged.

Figure 2:
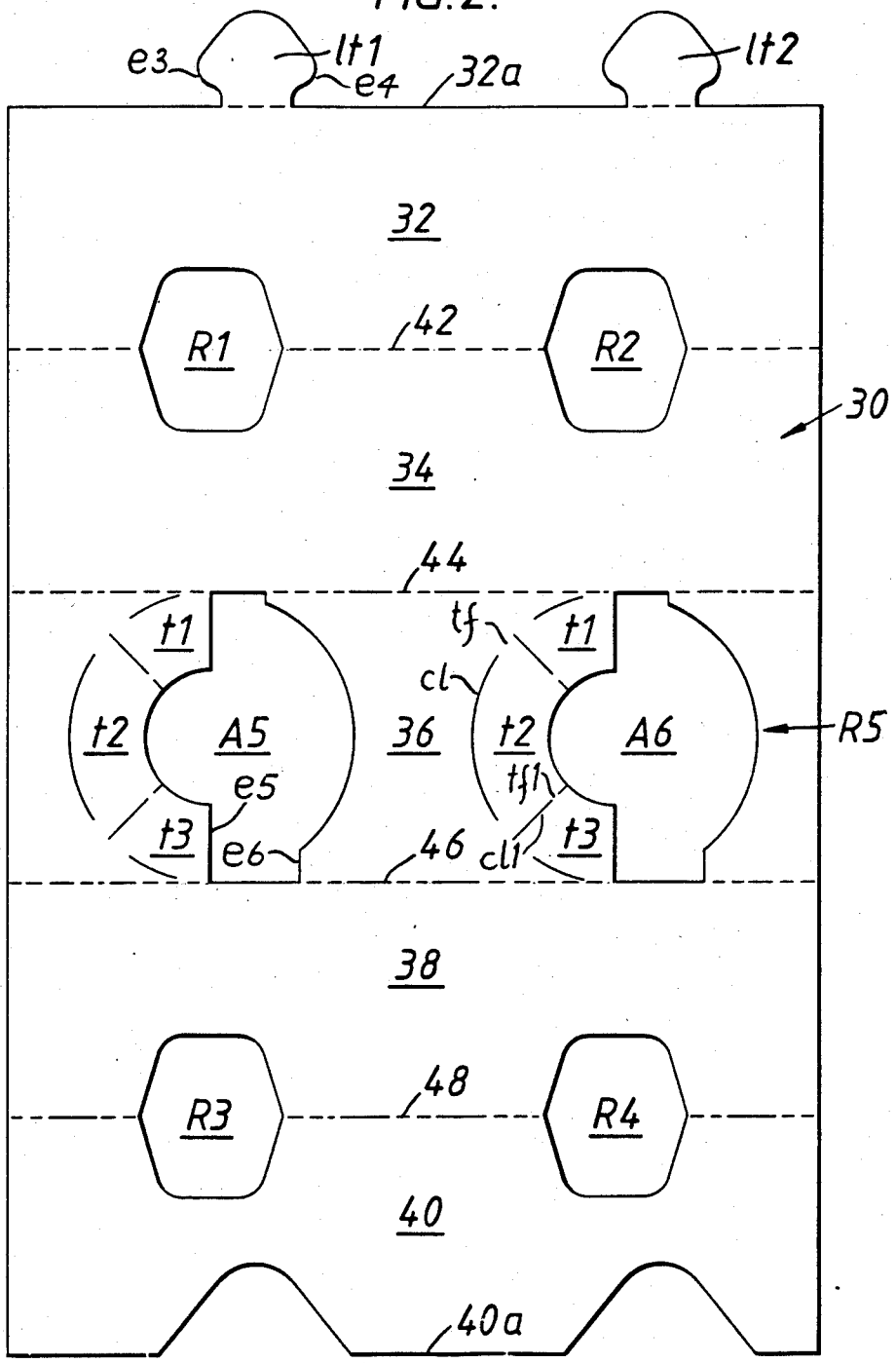
FIG. 2 is a plan view of another wrapper blank for forming a single-row top-gripping carrier according to the invention.

FIG. 2 shows an elongate blank 30 formed from paperboard or similar foldable sheet material which comprises, in series, a first outer side wall panel 32, a second outer side wall panel 34, a base panel 36, a first inner side wall panel 38 and a second inner side wall panel 40 hinged one to the next along transverse fold lines 42, 44 46 and 48 respectively.

The base panel 36 is formed with a row R5 of spaced apertures A5 and A6 each of which is adapted to receive the top of a bottle and includes a part-annular series of arcuate tabs t1–t3. The tabs are hinged to the base panel about short fold lines 'tf' which are disposed between cut lines 'ce'. Similarly, the tabs are hinged one to the next about short fold lines 'tf1' which are disposed between cut lines 'ce1'. When the completed carrier is applied to a pair of bottles, a bottle top is inserted through each aperture A5, A6 whose hinged tabs are broken away from one another along out lines 'ce1' and are upwardly displaced and locate against the bottle neck to assist in the stabilisation and/or retention of the bottle in the carrier.

The apertures A5 and A6 are partially clear of arcuate tabs 't' in order to facilitate the application of the carrier onto the bottles. Another pair of bottle top receiving apertures R1 and R2 is struck partially from each of the outer side wall panels 32 and 34 along transverse fold line 42 and a similar pair of bottle top receiving apertures R3 and R4 is struck partially from each of the inner side wall panels 38 and 40 along transverse fold line 48.

When the blank is formed into a tubular structure, as described below, apertures $R^1$ and $R^3$ are brought into close registry with one another above and vertically aligned with base panel aperture $A^5$. Likewise, apertures R2 and R4 are brought into close registry with one another above and vertically aligned with base panel aperture A6.

In order to maintain the carrier in its tubular configuration, a pair of arrow-head shaped locking tabs 'et1' and 'et2' extend from the transverse edge 32*a* of outer side wall panel 32.

The blank 30 is formed into a tubular structure (by a suitable folding device) of triangular cross-section by folding about the transverse fold lines so that first, the transverse edge 40*a* of the second inner side wall panel 40 is brought into abutment with the transverse fold line 44. Thus, the transverse fold line 48 forms the apex of a triangle whose sloping sides are constituted by side wall panels 38 and 40 and in which apertures $R^3$ and $R^4$ are disposed in spaced, vertically aligned relationship with base apertures $A^5$ and $A^6$ respectively. Outer side wall panels 34 and 32 are then brought into superposed relationship with inner side wall panels 40 and 38 respectively, so that apertures R1 and R2 are brought into close registry with apertures R3 and R4 respectively and transverse fold line 42 thereby forms the apex of the tubular structure thus formed and provides the top of the carrier. In this tubular configuration, the locking tabs 'et1' and 'et2' and project beyond the base panel 36 of the carrier adjacent transverse fold line 46 and are disposed next to respective ones of the apertures A5 and A6 and subsequently are folded into overlapping relationship with the base panel 36.

The tubular structure is then applied to a pair of bottles so that a neck portion of each bottle is introduced through respective ones of the base panel apertures A5 and A6 and through the registering top apertures R1R3, R2R4.

Referring specifically to locking tab 'et1' and base panel aperture A5, as a bottle neck is inserted through aperture A5 it strikes against the locking tab 'et1' which partially overlies tab t3 and displaces the locking tab 'et1' together with tabs t1–t3 in a direction inwardly of the tubular structure into the space between the top of the carrier and the base panel. In so doing, locking edges e3 and e4 of the locking tab 'et1' engage beneath e5 of tab t3 and beneath fixed edge e6 of the aperture and thereby lock the tab 'et1' in the aperture A5. Locking tab 'et2' is similarly engaged in aperture A6 by a bottle introduced into aperture A6 thereby securing outer side wall panel 32 to the base panel 36 and maintaining the completed carrier in its erected condition.

(FIG. 4) When the neck portion of the bottle is fully inserted through aperture A5 and registering apertures R1 $R^3$ the displaced tabs t1–t3 and the displaced locking tab 'et1' engage against the neck portion of the bottle and stabilise the bottle against undue sideways movement in the carrier. The bottle top or neck flange is retained by peripheral edge portions of the top apertures R1,R3. The stabilising and locking tabs associated with the other aperture A6 are similarly displaced and also serve to stabilise a bottle present in that aperture.

A modified carrier of similar construction but which includes a greater number of bottle receiving apertures is envisaged.

Figure 4:
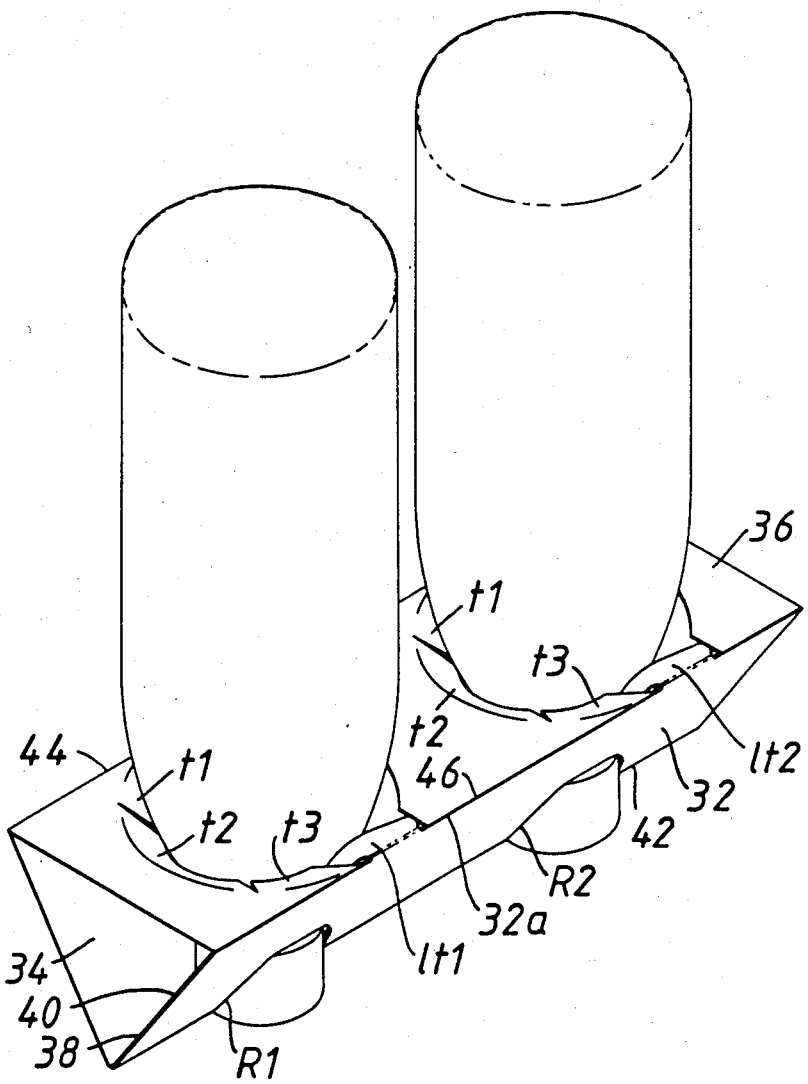
FIG. 4 is a perspective view of a carrier formed from the blank of FIG. 2, being shown in an inverted attitude and loaded with two bottles.

It is further envisaged that a modified version of the bottle carrier described with reference to FIGS. 2 and 4 may include retention tabs et1, et2, which do not have locking edges e3, e4. In such an arrangement, the tabs et1, et2, may have straight parallel edges and the tabs t1–t3 omitted from the base panel article receiving apertures A5, A6. Such a carrier would not be preformed but each retention tab would be folded into an article receiving aperture to extend within the tubular structure so as to maintain the carrier in erected condition at a time when a bottle is inserted through that aperture. Thus, when the bottle top is fully loaded into the carrier, so that its neck flange or cap is located in the aperture in the top of the carrier, the retention tab is maintained in folded condition by the bottle.

We claim:

1. An article carrier of the top-gripping type which connects together and supports a plurality of bottles by their flanged neck portions, the carrier being formed from a single elongated blank of foldable sheet material having a series of panels joined along transverse fold lines, said blank including terminal panels at opposing ends thereof and which, when assembled, provides a top and a base interconnected by spaced side wall panels and together form a tubular structure, said top and base each having a plurality of article receiving apertures with the apertures in the top disposed in registry with the apertures in the base, at least one retention tab being provided on at least one of said terminal panels, said retention tab being positioned adjacent one of said apertures in the base and being engaged therein, characterized in that said retention tab is folded inwardly through said one aperture to extend within said tubular structure so as to maintain said carrier in erected condition when a bottle has been inserted through the aperture in the base and the flange or cap thereof positioned in said aperture in the top whereby said retention tab is maintained in folded condition by said bottle.

2. The article carrier according to claim 1, further characterized in that said retention tab cooperates with portions of the base to maintain the tab within the tubular structure after insertion through said aperture in the base.

3. The article carrier according to claim 2, further characterized in that said retention tab cooperates with at least one flap hinged to a peripheral portion of said adjacent article receiving aperture and positioned for displacement by said retention tab during insertion of said tab.

4. The article carrier according to any of the preceding claims, further characterized in that said tubular structure is of rectangular cross-section and in that said base comprises a pair of base panels secured in partial overlapping relationship, one of said base panels being said terminal which is provided with said retention tab.

5. The article carrier according to any of claim 1 to 3, further characterized in that said tubular structure is of triangular cross section, one of said side walls being said terminal panel which is provided with said retention tab.

6. A blank for forming the carrier according to claim 1, which blank comprises, in series, a first base panel, a first side wall panel, a top panel, a second side wall panel, and a second base panel hinged one to the next, said top panel and each base panel being formed with article receiving apertures arranged such that each of the article receiving apertures in the top panel are disposed in registry with a separate one of the article receiving apertures in the base panel when the blank is erected to form said carrier, characterized in that said first base panel is provided with a plurality of said retention tabs each of which is sized and positioned for insertion into respective ones of the article receiving apertures in said second base panel when the base panels are brought into overlapping relationship.

7. A blank for forming the carrier according to claim 1, which blank comprises, in series, a first outer side wall panel, a second outer side wall panel, a base panel, a first inner side wall panel and a second inner side wall panel hinged one to the next, said side wall panels and said base panel being formed with article receiving apertures arranged such that each of the article receiving apertures in the side wall panels are disposed in registry with one of the article receiving apertures in the base panel when the blank is erected to form said carrier, characterized in that said first outer side wall panel is provided with a plurality of said retention tabs each of which is sized and positioned for insertion into respective ones of the article receiving apertures in said base panel when said first outer side wall panel is brought into overlapping relationship with said first inner side wall panel.

8. A method of assembling a carrier of the top-gripping type which connects together and supports a plurality of bottles by their flanged neck portions or caps, said carrier being formed from a single elongated blank of sheet material having a series of panels joined along transverse fold lines, said blank including terminal plates at opposing ends thereof and, when assembled into a tubular structure, provide a top and a base interconnected by spaced side wall panels, said top and base having a plurality of article receiving apertures and at least one retention tab being provided on at least one of said terminal panels in general alignment with a respective one of said apertures in the base, the method being characterized by the steps of folding said blank about said fold lines so that the apertures in the top are disposed in registry with the apertures in the base and said retention tab is disposed adjacent said respective aperture in the base, folding said retention tab relative to its associated terminal panel inwardly through said respective aperture in the base to extend within the tubular structure, and inserting a bottle with its neck portion through said respective aperture in the base so that the flange or cap thereof is positioned in the aperture in the top whereby said retention tab is maintained in folded condition by said bottle.

* * * * *